US007558664B2

(12) United States Patent
Banba et al.

(10) Patent No.: US 7,558,664 B2
(45) Date of Patent: Jul. 7, 2009

(54) OUTBOARD MOTOR FUEL CONTROLLER

(75) Inventors: Takaaki Banba, Shizuoka (JP); Yoshikazu Nakayasu, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 11/954,079

(22) Filed: Dec. 11, 2007

(65) Prior Publication Data

US 2008/0154480 A1 Jun. 26, 2008

(30) Foreign Application Priority Data

Dec. 21, 2006 (JP) ..... 2006-343813

(51) Int. Cl.
*F02D 41/12* (2006.01)
*F02M 69/28* (2006.01)

(52) U.S. Cl. ..... 701/104; 123/493

(58) Field of Classification Search ..... 123/492, 123/493, 399, 305, 352; 701/103–105
See application file for complete search history.

(56) References Cited

U.S. PATENT DOCUMENTS 4,730,591 A * 3/1988 Gohara et al. ..... 123/510
4,820,215 A * 4/1989 Mizusawa et al. ..... 440/88 R
5,172,666 A 12/1992 Nonaka
5,184,589 A 2/1993 Nonaka
5,241,939 A 9/1993 Nonaka
5,727,522 A * 3/1998 Otani et al. ..... 123/339.11
6,116,228 A * 9/2000 Motose et al. ..... 123/679
6,227,172 B1 * 5/2001 Katayama et al. ..... 123/463
6,539,299 B2 * 3/2003 Chatfield et al. ..... 701/104
7,023,102 B2 * 4/2006 Itoh ..... 290/40 C

FOREIGN PATENT DOCUMENTS

JP 08-121233 A 5/1996

* cited by examiner

*Primary Examiner*—Stephen K. Cronin
*Assistant Examiner*—Johnny H. Hoang
(74) *Attorney, Agent, or Firm*—Keating & Bennett, LLP

(57) ABSTRACT

To enable smooth, highly accurate deceleration in various usage conditions of an outboard motor and realize stabilized engine speed after deceleration, a fuel controller for controlling the amount of fuel fed to an engine of an outboard motor mounted on a boat includes a deceleration determining section arranged to determine deceleration of the boat, an engine speed detecting section arranged to detect the engine speed of the engine, an engine load detecting section arranged to detect the load on the engine, and a controller arranged to control the amount of fuel fed to the engine when the boat is in deceleration according to the detected engine speed and engine load.

4 Claims, 5 Drawing Sheets

| | LOAD 0 | LOAD 10 | • | • | • | • | LOAD 100 |
|---|---|---|---|---|---|---|---|
| ENGINE SPEED 250 | 0 | 10 | | | | | |
| 500 | 10 | 20 | | | | | |
| • | | | | | | | |
| • | | | | | | | |
| • | | | | | | 80 | 90 |
| 6000 | | | | | | 90 | 100 |

FIG. 6

| | | ESTIMATED BOAT SPEED VALUE FOR DECELERATION AND AMOUNT REDUCTION | | | | | | | | | | |
|---|---|---|---|---|---|---|---|---|---|---|---|---|
| | | 0 | 5 | 10 | 15 | • | • | • | • | • | 80 | 100 |
| ENGINE SPEED | 250 | 1.00 | 0.99 | 0.98 | | | | | | | | |
| | 500 | 1.00 | 0.98 | 0.97 | | | | | | | | |
| | 1000 | 1.00 | 0.97 | 0.96 | | | | | | | | |
| | 1500 | 1.00 | 0.96 | 0.95 | | | | | | | | |
| | • • • • | | | | | | | | | | | |
| | 5500 | | | | | | | | | | 0.10 | |
| | 6000 | | | | | | | | | | | 0.00 |

OUTBOARD MOTOR FUEL CONTROLLER

BACKGROUND OF THE INVENTION

1. Field of the Invention

The present invention relates to an outboard motor fuel controller for controlling the amount of fuel fed to an outboard motor engine that is mounted on a boat when the boat is in deceleration.

2. Description of the Related Art

As described in JP-A-Hei 8-121233, there is an engine controller for vehicle-mounted engines in which the amount of fuel fed to the engine is controlled according to the intake pipe pressure and the engine speed. This controller controls a fuel injection amount according to the intake pipe pressure detected with a sensor in the operation range where a correlation exists between the intake pipe pressure and the engine intake air amount in stationary operation of the engine. In the range where the correlation is lost, the fuel injection amount is controlled according to a throttle valve opening degree and engine speed.

In outboard engines mounted on boats, the extent of a decrease in fuel is conventionally determined according to only engine speed when the boat is decelerating. See, for example, JP-A-Hei 4-179839.

In this way, the fuel amount reduction compensation in boats during deceleration has been conventionally done only with the engine speed as a control factor. However, boats running on the water are largely different in the manner of deceleration from vehicles running on the road, depending on the type of the outboard motor propeller, type of the hull of the boat, and the manner of deceleration. As a result, there have been cases in which the required optimum fuel compensation amount changes, so that fuel feed amount is too much or too little, resulting in instability in engine speed after deceleration.

SUMMARY OF THE INVENTION

In order to overcome the problems described above, preferred embodiments of the present invention provide an outboard motor fuel controller that makes it possible to decelerate smoothly and very accurately under various circumstances of use of the outboard motor and to stabilize the engine speed after deceleration. To solve the above problems and accomplish the object, this invention is constituted as described below.

According to a preferred embodiment of the present invention, an outboard motor fuel controller for controlling an amount of fuel fed to an outboard motor engine mounted on a boat includes a deceleration determining section arranged to determine deceleration of the boat, an engine speed detecting section arranged to detect a revolution of the engine, an engine load detecting section arranged to detect a load on the engine, and a controller arranged to control the amount of fuel fed to the engine when the boat is in deceleration according to the detected engine speed and engine load.

The controller, when starting the control of fuel amount fed to the engine, preferably presets an initial value of fuel compensation amount according to the engine speed and engine load.

The controller preferably carries out a dividing calculation of the preset initial value of fuel compensation amount at certain time intervals, and obtains an estimated value of the fuel compensation amount.

The controller preferably determines a compensation factor based on the calculated, estimated value of the fuel control compensation amount and on the engine speed, and determines a final fuel feed amount based on the compensation factor.

According to a preferred embodiment of the present invention, as the amount of fuel fed to the engine when the boat is decelerated is controlled according to the detected engine speed and engine load, the fuel amount is optimized under any operating situations, deceleration is smooth and highly accurate, and a stabilized engine speed is maintained after the deceleration.

Also, as the initial value of the fuel compensation amount is preset according to engine speed and the engine load when the control of the fuel amount fed to the engine is started, the fuel feed amount may be calculated according to various engine load conditions and reflected in the fuel control.

As a result of the dividing calculation of the initial value of the preset fuel compensation amount being carried out at certain time intervals to obtain the estimated value of the fuel compensation amount, it is possible to carry out smoothly converging fuel control with smooth deceleration and maintain the engine speed stabilized after deceleration.

As the compensation factor is obtained according to the calculated estimated value of the fuel control compensation amount and the engine speed, the final fuel feed amount is determined according to the compensation factor, and fuel control is made to match the manner of decreasing the engine speed, it is possible to feed an optimum amount of fuel according to the engine load situation.

While a fuel controller of an outboard motor is described below as one preferred embodiment of the present invention, this preferred embodiment represents one of the most preferable forms of the present invention. However, the present invention is not limited to this preferred embodiment.

Other features, elements, processes, steps, characteristics and advantages of the present invention will become more apparent from the following detailed description of preferred embodiments of the present invention with reference to the attached drawings.

BRIEF DESCRIPTION OF DRAWINGS

FIG. 6 is a table of the deceleration and amount reduction compensation factor map.

DETAILED DESCRIPTION OF PREFERRED EMBODIMENTS

Figure 1:
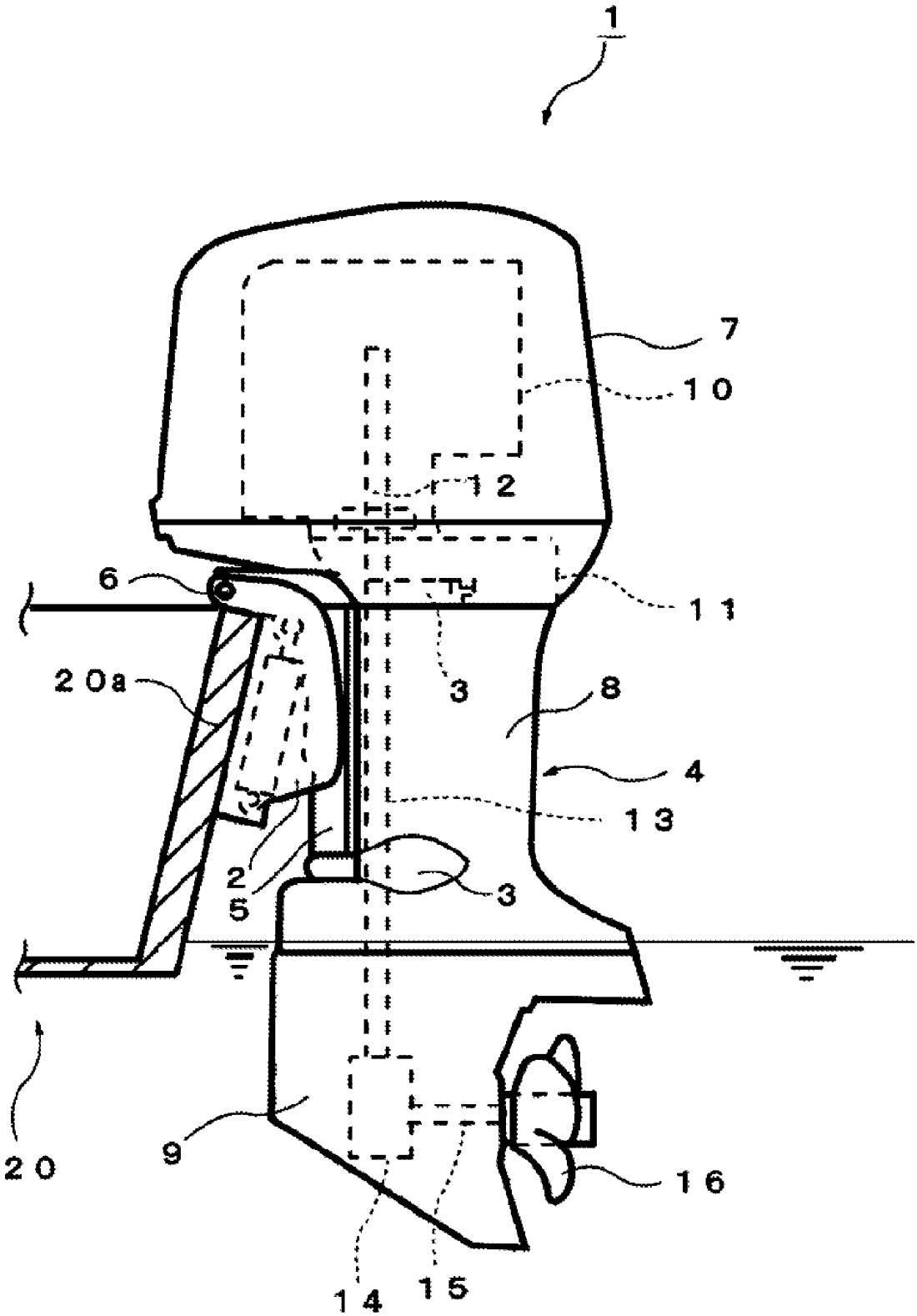
FIG. 1 is a side view of an outboard motor according to a preferred embodiment of the present invention.

First, an outboard motor provided with a fuel controller is described. FIG. 1 is a side view of the outboard motor. The outboard motor 1 is attached through a clamp bracket 2 to a transom 20*a* of a hull 20 of a boat. A swivel bracket 5, elastically supporting a propulsion unit 4 through upper and lower reduction members 3, is pivoted on the clamp bracket 2 for free up-and-down turn through a tilt shaft 6.

The propulsion unit 4 has a housing made up of a cowling 7, an upper case 8, and a lower case 9. A four-stroke cycle engine 10 is housed in the cowling 7. The engine 10 is supported with an exhaust guide 11.

In the engine 10, a crankshaft 12 is disposed in the longitudinal direction. The upper end of a driveshaft 13 vertically extending through the upper crankcase 8 is connected to the crankshaft 12. The lower end of the driveshaft 13 is connected to a forward-backward motion switching mechanism 14 housed in the lower case 9. A propeller shaft 15 extends from the forward-backward motion switching mechanism 14. The rear end of the propeller shaft 15 projecting out of the lower case 9 is provided with a propeller 16.

Figure 2:
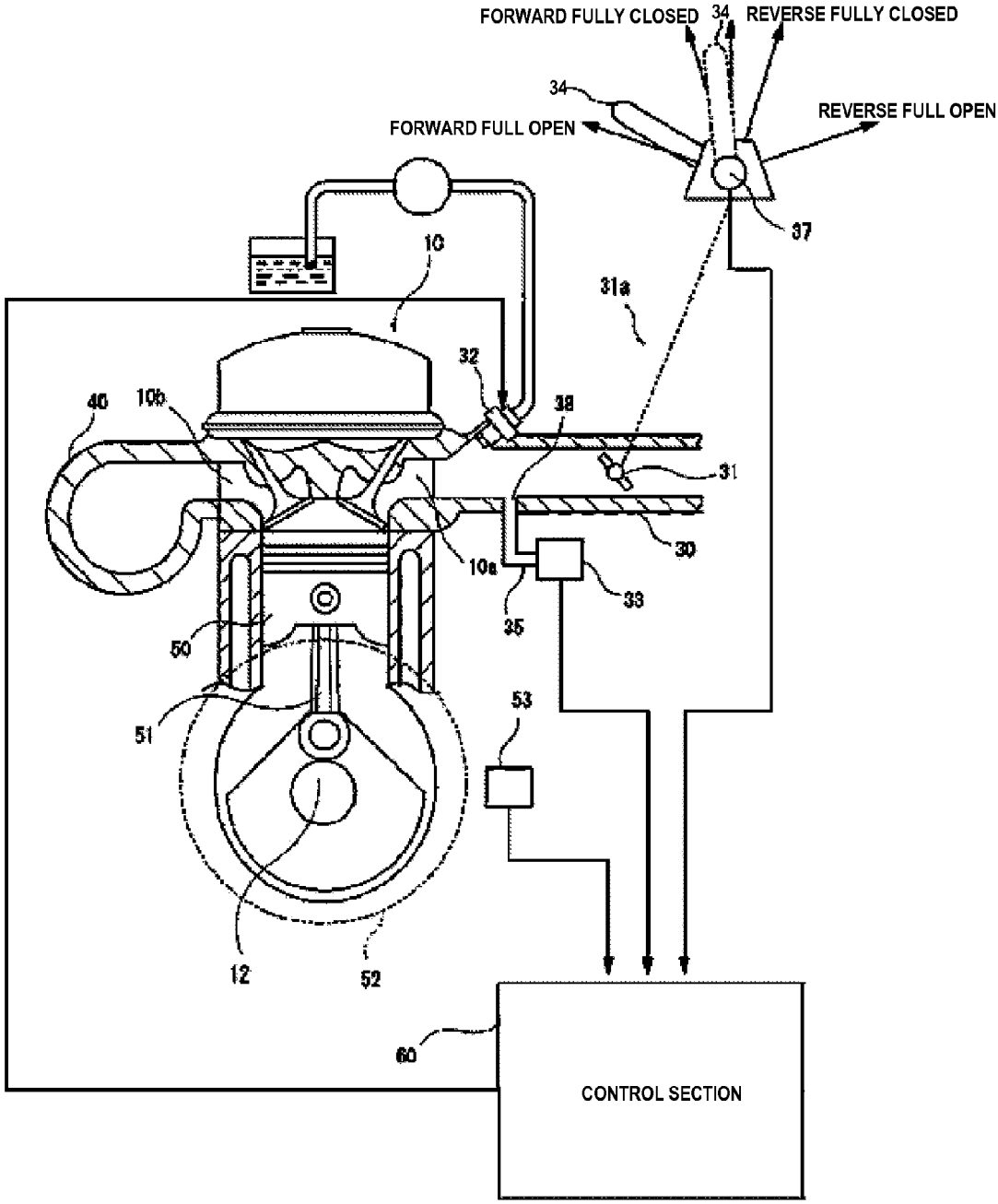
FIG. 2 is a schematic view of an entire constitution of the engine.

Next, the engine 10 provided with the fuel controller is described. FIG. 2 is a schematic view showing the entire constitution of the engine. A cylinder of the engine 10 is connected to an intake pipe 30 and an exhaust pipe 40. In the intake pipe 30 are disposed a throttle valve 31, a fuel injection valve 32, and an intake pressure sensor 33. The throttle valve 31 comes to an opening degree commensurate with the amount of operation of an operation lever 34 by an operator. The fuel injection valve 32 injects pressurized fuel into an intake passage 10*a* of the cylinder of the engine 10. The intake pressure sensor 33 is disposed in a pressure duct 35 which is in communication with an intake pipe pressure sensing port 38 provided in the downstream side portion of the throttle valve 31. The intake pressure sensor 33 produces a voltage signal commensurate with the pressure (absolute pressure) in the intake pipe 30 acting through the pressure duct 35. The exhaust pipe 40 is connected to an exhaust passage 10*b*.

The throttle valve 31 is connected to an operation mechanism 31*a* linked to the operation lever 34. The throttle valve 31 may be operated by operating the operation lever 34. The operation mechanism 31*a* is provided with a throttle opening degree sensor 37 for producing a voltage signal commensurate with the position (opening degree) of the operation lever 34.

In the cylinder of the engine 10 is provided a piston 50 for free reciprocating motion. The piston 50 is connected through a piston rod 51 to the crankshaft 12 rotated by the reciprocating motion of the piston 50. The crankshaft 12 is provided with a flywheel 52. A crankshaft sensor 3 for producing a pulse signal commensurate with the revolution of the crankshaft 12 is provided in a position opposite the flywheel 52.

The voltage signal of the intake pressure sensor 33, the voltage signal of the throttle opening degree sensor 37, and the pulse signal of the crankshaft sensor 53 are inputted to a control section 60. The control section 60 is constituted for example with a microcomputer. To the control section 60 is connected the fuel injection valve 32 to calculate the control amount of the fuel injection amount of the engine 10 according to the intake pressure, the throttle valve opening degree, and the engine speed, and to carry out basic control of the fuel injection amount.

According to this preferred embodiment, the amount of fuel fed to the engine, when the boat is in deceleration, is controlled according to detected engine speed and engine load. That is, a compensation factor is determined according to the detected engine speed and engine load to carry out fuel injection amount compensation control or control of fuel compensation amount for the engine according to the compensation factor.

Figure 3:
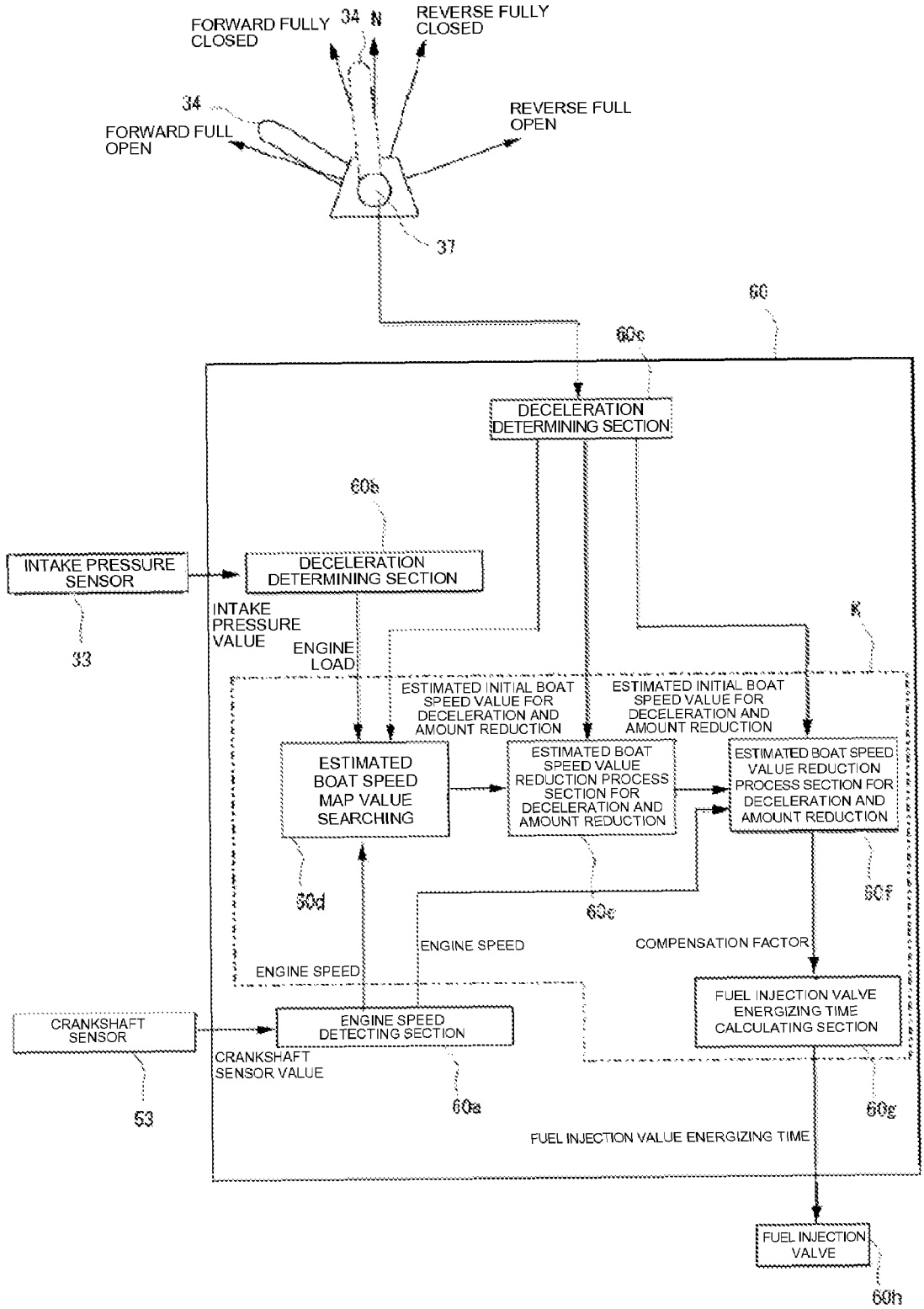
FIG. 3 is a constitutional view of the control section.

The calculation of the fuel injection amount compensation of the engine 10 is described using FIG. 3. FIG. 3 shows the constitution of the control section. In this preferred embodiment, the control section 60 preferably includes an engine speed detecting section 60*a*, an engine load detecting section 60*b*, a deceleration determining section 60*c*, and a controller k. The controller k preferably includes an estimated boat speed map value searching section 60*d* for deceleration and amount reduction, an estimated boat speed value reduction process section 60*e* for deceleration and amount reduction, a compensation factor map value searching section 60*f* for deceleration and amount reduction, and a fuel injection valve energizing time calculating section 60*g*, to control the fuel compensation amount for the engine 10 of the outboard motor 1 when the boat is in deceleration.

The engine speed detecting section 60*a* calculates the engine speed (rotational speed) according to pulse intervals of pulse signals from the crankshaft sensor 53, and sends the engine speed (rotational speed) data to the estimated boat speed map value searching section 60*d* for deceleration and amount reduction, and to the compensation factor map value searching section 60*f* for deceleration and amount reduction.

The engine load detecting section 60*b* detects a load on the engine 10 using the voltage signal from the intake pressure sensor 33, and sends the engine load data to the estimated boat speed map value searching section 60*d* for deceleration and amount reduction, and to the compensation factor map value searching section 60*f* for deceleration and amount reduction.

The deceleration determining section 60*c* determines that the boat is in deceleration when all the following conditions (a), (b), and (c) are met according to both the voltage signal of the throttle opening degree sensor 37 and the engine speed from the engine speed detecting section 60*a*. To decelerate the boat, as is seen in FIG. 3, for example, the operation lever 34 is moved from the full open throttle position for forward motion to the fully closed position either rapidly or slowly to bring the throttle valve 31 from the full open position to the fully closed position. Because the decelerating state of the boat running on the water varies widely depending on the type of the propeller of the outboard motor 1 and the manner of deceleration such as rapid deceleration, the sensor for detecting the boat speed may be provided underwater to determine the deceleration of the boat from the detected values.

By the above-described decelerating operation, whether or not the following conditions are met is determined as follows:

Condition (a): a throttle request value based on the voltage signal corresponding to the motion (opening degree) of the throttle lever 34, for example, from the full open position for forward motion to the fully closed position is equal to or smaller than a deceleration determining throttle request value stored in the deceleration determining section 60*c;*

Condition (b): the engine speed of deceleration is greater than the deceleration determining revolution stored in the deceleration determining section 60*c*; and Condition (c): the engine speed of deceleration is greater than the deceleration determining revolution stored in the deceleration determining section 60*c*, and a deceleration limit time elapses after the deceleration determination has been changed from negative to affirmative.

When all the above conditions (a), (b), and (c) are met, the boat is determined to be in deceleration. When any of the above conditions is not met, the boat is determined not to be in deceleration, no fuel compensation control is carried out but the basic fuel injection amount control is carried out.

In other words, when any of the above conditions (a), (b), and (c) is not met, the estimated boat speed map value searching section 60*d* for deceleration and amount reduction, the estimated boat speed value reduction process section 60*e* for deceleration and amount reduction, and the compensation factor map value searching section 60*f* for deceleration and amount reduction are not operated. Instead, the basic fuel injection amount (injection time of the fuel injection valve) is calculated by the fuel injection valve energizing time calculating section 60*g*.

Figures 4, 5:
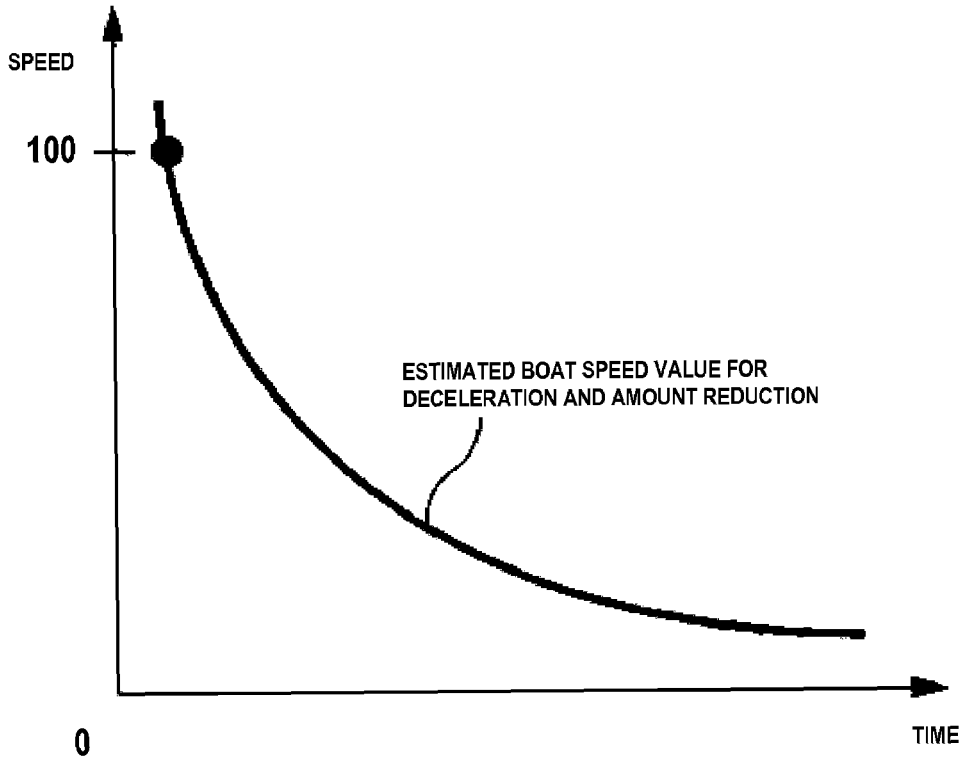
FIG. 4 is a table of the estimated boat speed value map for deceleration and amount reduction.
FIG. 5 is a graph for determining the estimated boat speed value for deceleration and amount reduction.

When all the conditions (a), (b), and (c) are met, the boat is determined to be in deceleration. The estimated boat speed map value searching section 60*d* for deceleration and amount reduction, when starting fuel control in deceleration, based on the detected engine speed and the detected engine load, and using the estimated boat speed value map for deceleration and amount reduction shown in FIG. 4, sets an initial value of fuel compensation amount for fuel control. In other words, for example, the estimated boat speed value map for deceleration and amount reduction shown in FIG. 4 plots engine speed in the range of 250 rpm to 6000 rpm on its vertical axis and engine load of intake pressure in the range in numerical value of 1 to 100 on its horizontal axis, and has stored in advance initial map values of fuel compensation amount corresponding to engine speed and engine load. From this map, when engine speed is 6000 rpm and engine load is 100, for example, an initial value of fuel compensation amount of 100 is set.

The estimated boat speed value reduction process section 60*e* for deceleration and amount reduction performs calculation of dividing the initial value of the preset fuel compensation amount for fuel compensation control at certain time intervals to obtain the estimated boat speed value for deceleration and amount reduction shown in FIG. 5. For example, it is possible to obtain the estimated boat speed value for deceleration and amount reduction of fuel compensation amount shown in FIG. 5 by multiplying the preset initial value of 100 of fuel compensation amount for fuel compensation control by a boat speed reduction factor of 1 or less to reduce it by a constant ratio down to zero.

The compensation factor map value searching section 60*f* for deceleration and amount reduction obtains from the deceleration and amount reduction compensation factor map shown in FIG. 6 a compensation factor based on both the estimated boat speed value for deceleration and amount reduction of fuel compensation amount shown in FIG. 5 and the engine speed. For example, when the engine speed is 6000 rpm and the estimated boat speed value for deceleration and amount reduction of fuel compensation amount is 100, the compensation factor is 0.00, so that the fuel compensation amount is increased and the fuel injection amount is made zero.

Further, when the engine speed is 250 rpm and the estimated boat speed value for deceleration and amount reduction of fuel compensation amount is 0, the compensation factor is 1.00, so that the basic fuel injection amount control is carried out without making the fuel compensation.

In this way, the compensation factor is determined from the calculated, estimated boat speed value for deceleration and amount reduction of fuel compensation amount for fuel compensation control and the engine speed of the outboard motor 1 on the decelerating boat. Based on the compensation factor, a final fuel compensation amount is determined. Compensation is made to reduce the fuel compensation amount determined from the basic fuel injection amount, and an instruction is given to the fuel injection valve energizing time calculating section 60*g*.

The fuel injection valve energizing time calculating section 60*g* according to the instruction from the fuel injection valve energizing time calculating section 60*g* operates the fuel injection valve 32 for the fuel injection valve energizing time obtained by calculation to inject pressurized fuel into the intake passage 10*a* of the cylinder of the engine 10.

In this way, the fuel controller of the engine 10, when the boat is in deceleration, uses the controller of the control section 60 to control the fuel compensation amount of the engine 10 of the outboard motor 1. This control makes it possible to feed fuel suitably and very accurately in various operating situations by obtaining the compensation factor based on the detected engine speed and engine load, and controlling the fuel feed amount to the engine based on the compensation factor.

Therefore, it is possible to make smooth, very accurate deceleration to maintain stabilized engine speed after the deceleration.

Further, because the initial value of the fuel compensation amount for the fuel control is set on the basis of the engine speed and the engine load when the boat is in deceleration, it is possible to calculate the fuel compensation amount corresponding to various load conditions of the engine 10 and have it reflected in the control.

Further, as the fuel compensation is made in which the dividing calculation of the preset initial value of the fuel compensation amount for fuel compensation control is made at certain time intervals to obtain the estimated boat speed value for deceleration and amount reduction and the value is made to converge smoothly down to a certain value, it is possible to make smooth deceleration and maintain the engine speed stabilized after deceleration. Further, the fuel controller obtains the compensation factor based on the calculated, estimated boat speed value for deceleration and amount reduction of the fuel control compensation amount and the engine speed of the decelerating outboard motor 1 to determine the final fuel feed amount based on the compensation factor and to make fuel compensation according to the decelerating state of engine speed. Thus, it is possible to feed optimum amount of fuel according to the load condition of the engine 10.

Preferred embodiments of the present invention are applicable to the fuel controller of the outboard motor for controlling fuel amount fed to the engine of the outboard motor mounted on the boat when the boat is in deceleration. Preferred embodiments of the present invention make deceleration smooth and very accurate under various use conditions of the outboard motor and stabilize engine speed after the deceleration.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An outboard motor fuel controller for controlling an amount of fuel fed to an engine of an outboard motor mounted on a boat, the outboard motor fuel controller comprising:

a deceleration determining section arranged to determine deceleration of the boat;

an engine speed detecting section arranged to detect engine speed;

an engine load detecting section arranged to detect a load on the engine; and a controller arranged to control the amount of fuel fed to the engine when the boat is in deceleration according to the detected engine speed and engine load; wherein the deceleration determining section determines that the boat is in deceleration when a) a throttle request value is equal to or less than a predetermined deceleration determining throttle value, b) the engine speed is greater than a predetermined deceleration determining revolution, and c) a predetermined deceleration time limit elapses and conditions a) and b) are still satisfied.

2. The outboard motor fuel controller of claim 1, wherein the controller, when starting control of the fuel amount fed to the engine, is arranged to preset an initial value of a fuel compensation amount according to the engine speed and the engine load.

3. An outboard motor fuel controller for controlling an amount of fuel fed to an engine of an outboard motor mounted on a boat, the outboard motor fuel controller comprising:

a deceleration determining section arranged to determine deceleration of the boat;

an engine speed detecting section arranged to detect engine speed;

an engine load detecting section arranged to detect a load on the engine; and a controller arranged to control the amount of fuel fed to the engine when the boat is in deceleration according to the detected engine speed and engine load; wherein the controller, when starting control of the fuel amount fed to the engine, is arranged to preset an initial value of a fuel compensation amount according to the engine speed and the engine load; and the controller carries out a dividing calculation of the preset initial value of the fuel compensation amount at certain time intervals to obtain an estimated value of the fuel compensation amount.

4. The outboard motor fuel controller of claim 3, wherein the controller determines a compensation factor based on the calculated, estimated value of the fuel control compensation amount and on the engine speed, and determines a final fuel feed amount based on the compensation factor.

* * * * *